US006728600B1

(12) United States Patent
Contaldo et al.

(10) Patent No.: US 6,728,600 B1
(45) Date of Patent: Apr. 27, 2004

(54) DISTRIBUTED APPLIANCE CONTROL SYSTEM HAVING FAULT ISOLATION

(75) Inventors: Richard A. Contaldo, Cleveland Heights, OH (US); Robert D. Rothrock, Leroy, OH (US)

(73) Assignee: Honeywell International Inc., Morristown, NJ (US)

( * ) Notice: Subject to any disclaimer, the term of this patent is extended or adjusted under 35 U.S.C. 154(b) by 498 days.

(21) Appl. No.: 09/589,586

(22) Filed: Jun. 8, 2000

(51) Int. Cl.[7] ..... G05B 21/00

(52) U.S. Cl. ..... 700/274; 700/9; 700/20; 236/20 R; 236/21 R

(58) Field of Search ..... 431/13–16, 24–28, 431/66, 67, 70, 79, 264; 340/640; 361/247, 253; 236/1 A, 14, 20 R, 21 R, 15 A, 15 BB, 218, 94; 700/9–12, 17, 19–27, 79–81, 274–276, 299, 300

(56) References Cited

U.S. PATENT DOCUMENTS

| | | | | |
|---|---|---|---|---|
| 4,444,551 A | * | 4/1984 | Mueller et al. | 431/25 |
| 4,518,345 A | * | 5/1985 | Mueller et al. | 431/24 |
| 4,925,386 A | * | 5/1990 | Donnelly et al. | 431/28 |
| 5,103,078 A | * | 4/1992 | Boykin et al. | 219/494 |
| 5,549,469 A | * | 8/1996 | Wild et al. | 431/75 |
| 5,629,879 A | | 5/1997 | Lelle | 364/579 |
| 5,651,193 A | | 7/1997 | Rhodes et al. | 34/531 |
| 5,951,276 A | * | 9/1999 | Jaeschke et al. | 431/66 |
| 6,059,195 A | * | 5/2000 | Adams et al. | 236/20 R |
| 6,129,284 A | * | 10/2000 | Adams et al. | 236/21 R |

FOREIGN PATENT DOCUMENTS

| | | |
|---|---|---|
| EP | 0 325 356 A2 | 7/1989 |
| EP | 0 931 990 A2 | 7/1999 |

OTHER PUBLICATIONS

Abstract of Japanese Patent Application No. JP 11 018169 A, Publication No. 1108169, published on Jan. 22, 1999.
Abstract of Japanese Patent Application No. JP 11 134019 A, Publication No. 11134019, published May 21, 1999.
Abstract of Japanese Patent Application No. JP 04 062301 A, Publication No. 04062301, published Feb. 27, 1992.
Abstract of Japanese Patent Application No. JP 02 021123 A, Publication No. 02021123, published Jan. 24, 1990.

* cited by examiner

*Primary Examiner*—Maria N. Von Buhr

(57) ABSTRACT

An appliance controller suitable for controlling a heating appliance (e.g., gas-fired water heating apparatus) having a distributed control system. The distributed control system includes a host computer and one or more heating control units. In accordance with a preferred embodiment, each heating control unit takes the form of an ignition control for controlling operation of a gas-fired burner for a multi-stage boiler. The appliance controller also includes a fault isolation system for isolating the source of a malfunction, and providing service personnel with status information regarding components of the appliance. The appliance controller is adapted to provide variable output signals for adaptive control of some appliance components, such as a blower or a circulation pump.

33 Claims, 8 Drawing Sheets

DISTRIBUTED APPLIANCE CONTROL SYSTEM HAVING FAULT ISOLATION

FIELD OF INVENTION

The present invention relates generally to an appliance controller, and more particularly relates to a distributed appliance control system including a system for fault isolation.

BACKGROUND OF THE INVENTION

Prior art appliance control systems, such as those for gas-fired water heating appliances, have not provided users of the appliance with systems which are simple and convenient to maintain, repair, customize and upgrade. In this regard, prior art appliance control systems have not provided modularity in their design which would facilitate maintenance, repair, customization and upgrade of the control system. Moreover, these prior art systems have not provided detailed diagnostics which lead service technicians to the source of a malfunction in the control system or the appliance being controlled. These drawbacks to prior art control systems are particularly evident in relatively complex appliances such as multi-stage boilers, which include a plurality of burner chambers and burners.

The present invention addresses these and other drawbacks of prior art appliance control system designs to provide a control system which has a greater degree of simplicity and convenience with regard to appliance maintenance, repair, customization, upgrade and operation.

SUMMARY OF THE INVENTION

According to the present invention there is provided an appliance controller for controlling an associated gas appliance having at least one gas-fired burner means, the appliance controller comprising: one or more ignition control means, each ignition control means controlling ignition of an associated gas-fired burner means; a host computer for controlling operation of the one or more ignition control means; and a communications medium for facilitating communication between the host computer and the one or more ignition control means.

In accordance with another aspect of the present invention there is provided an appliance controller for controlling an associated gas appliance having at least one heating means, the appliance controller comprising: one or more heat control means, each heat control means controlling activation and deactivation of an associated heating means; a host computer for controlling operation of the one or more heat control means; and a communications medium for facilitating communication between the host computer and the one or more heat control means.

In accordance with yet another aspect of the present invention there is provided a method for isolating a fault condition of an appliance, comprising the steps of: receiving status information indicative of the state of a plurality of components of the appliance; inputting the status information in parallel into a shift register; outputting the status information from the shift register in serial; receiving the output status information into a processing means; evaluating the received status information to determine if a fault condition exists; and displaying a signal indicative of the fault condition.

In accordance with yet another aspect of the present invention, there is provided an appliance controller for controlling an associated gas appliance having at least one gas-fired burner means, the appliance controller comprising: a control means for controlling ignition of an associated gas-fired burner means; and a blower for blowing air into a combustion chamber, wherein said blower has at least two different operating speeds, said operating speed determined by said control means.

An advantage of the present invention is the provision of an appliance control system having distributed subsystems.

Another advantage of the present invention is the provision of an appliance control system having a modular design which facilitates customization, maintenance, repair, and upgrade of the control system.

Still another advantage of the present invention is the provision of an appliance control system which is simple and convenient to customize, maintain, repair, and upgrade.

Yet another advantage of the present invention is the provision of an appliance control system having a modular design which facilitates customization, maintenance, repair, and upgrade of the control system.

Still other advantages of the invention will become apparent to those skilled in the art upon a reading and understanding of the following detailed description, accompanying drawings and appended claims.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

It should be appreciated that while a preferred embodiment of the present invention is described with particular reference to an appliance control system for controlling a gas-fired water heating device, the present invention is contemplated for use with other appliances, including those which generate heat using electricity, a heat pump, oil and the like. In addition, the gas-fired heating appliance may use a variety of suitable ignition systems, including standing pilot ignition, spark ignition and hot surface ignition. Moreover, it should be understood that the term hot water heater generally refers to a water heating device for heating potable water, while the term "boiler" generally refers to a water heating device for heating process water (e.g., water for industrial and space heating applications). For purposes of the present application, the terms "hot water heater" and "boiler" will be used interchangeably to refer to a water heating device.

Figure 1:
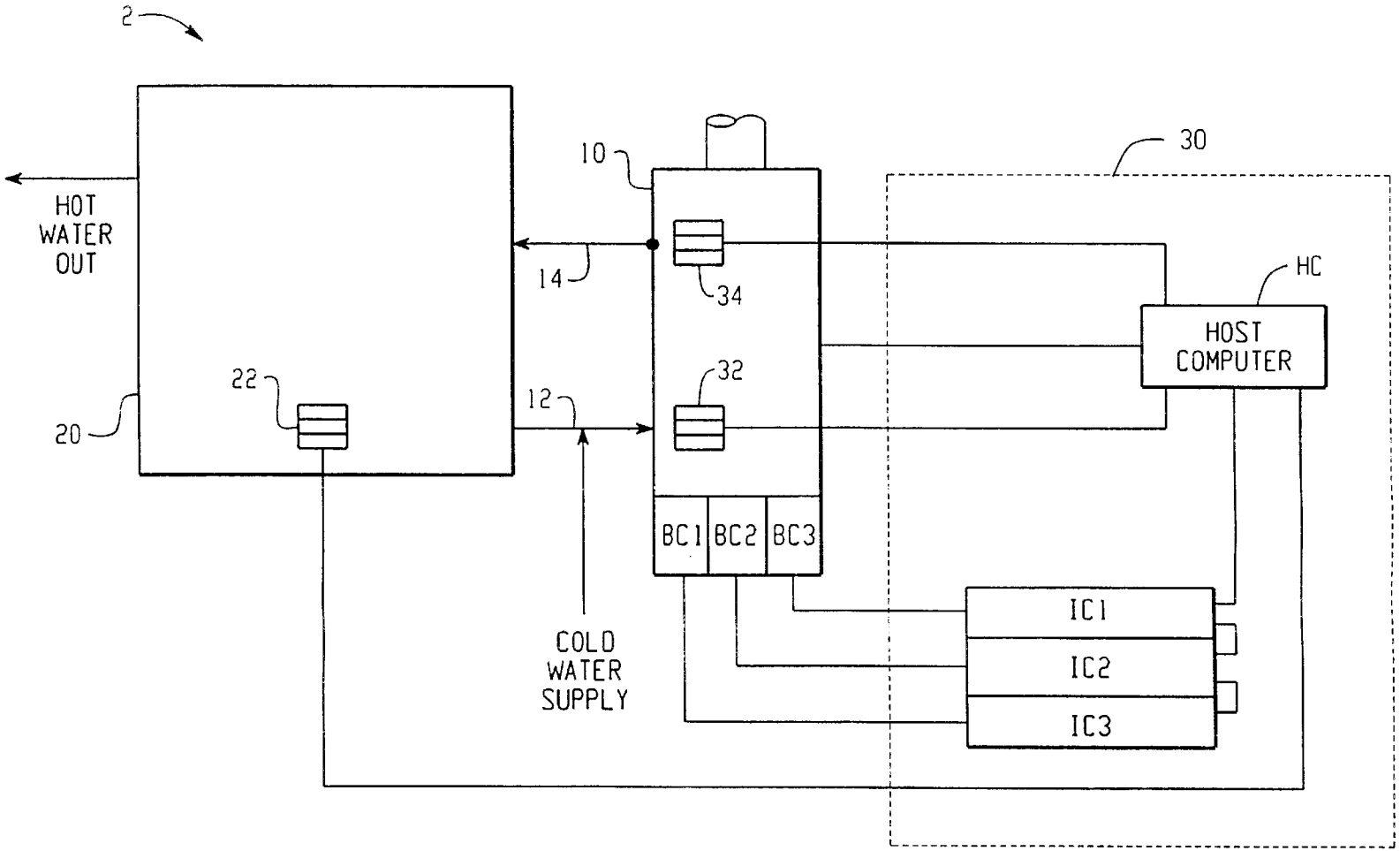
FIG. 1 is a block diagram of a water heating system including the appliance control system of the present invention.
Figure 2A:
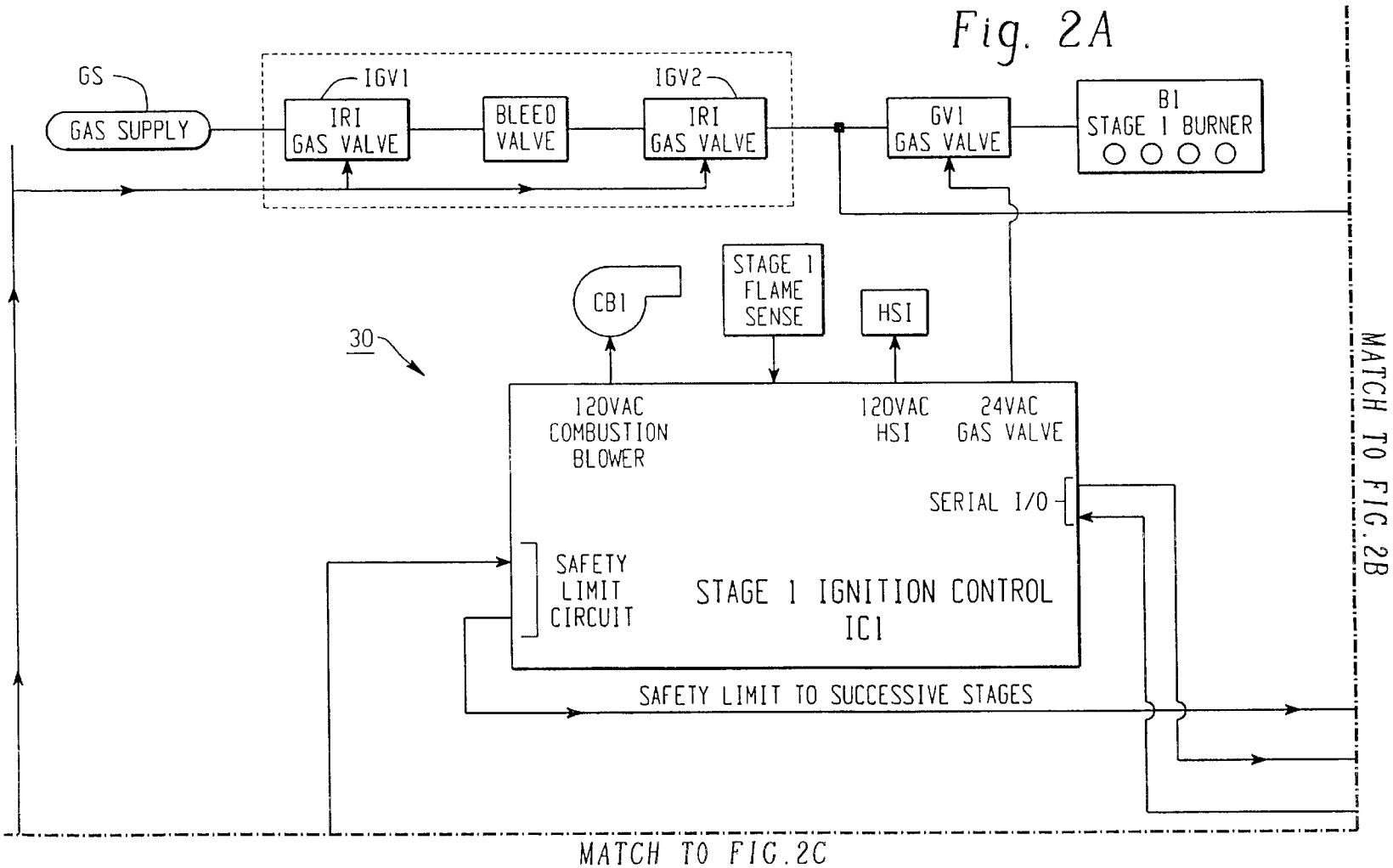
FIG. 2 is a detailed block diagram of the appliance control system, according to a preferred embodiment of the present invention.
Figure 2B:
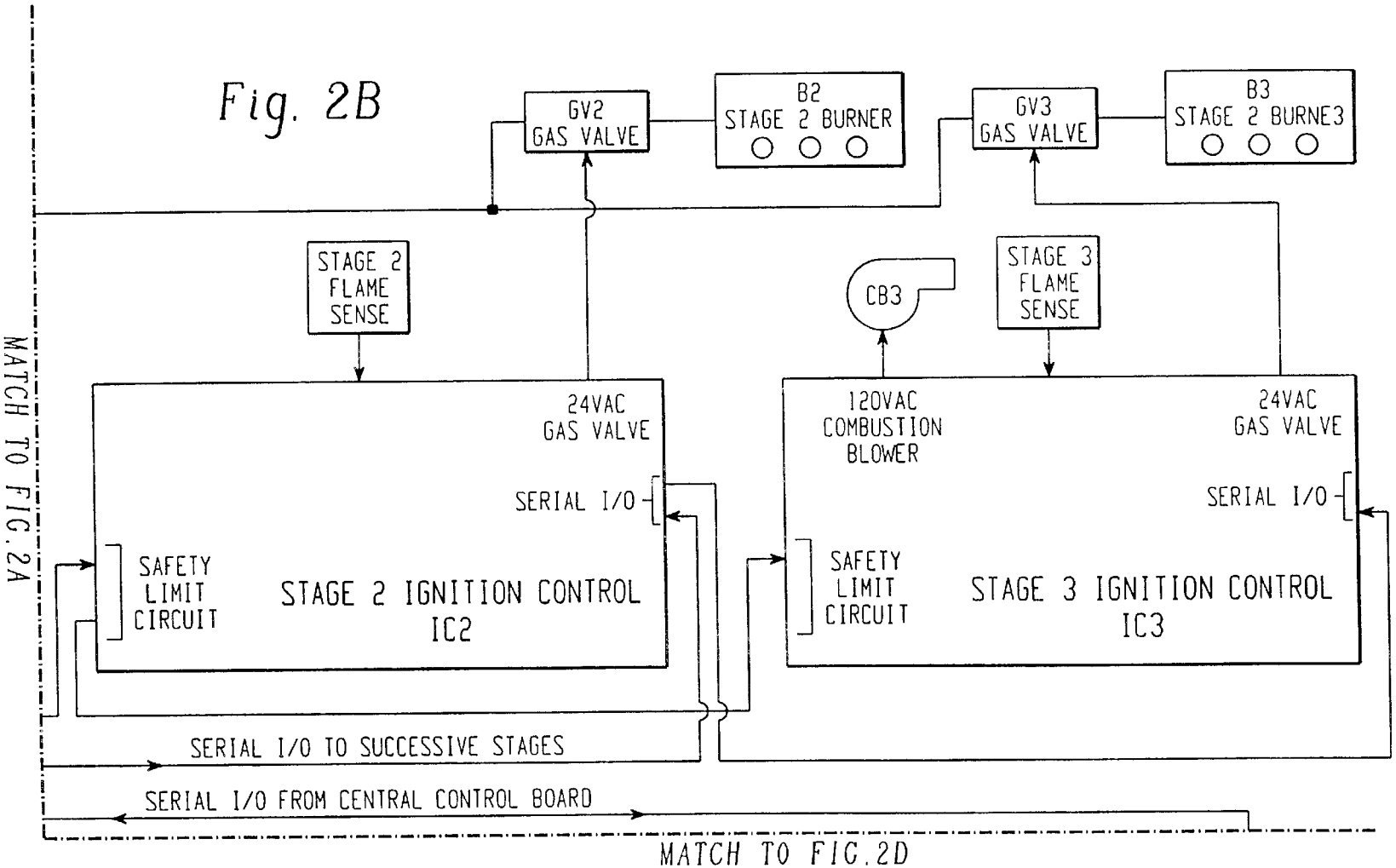
Figure 2C:
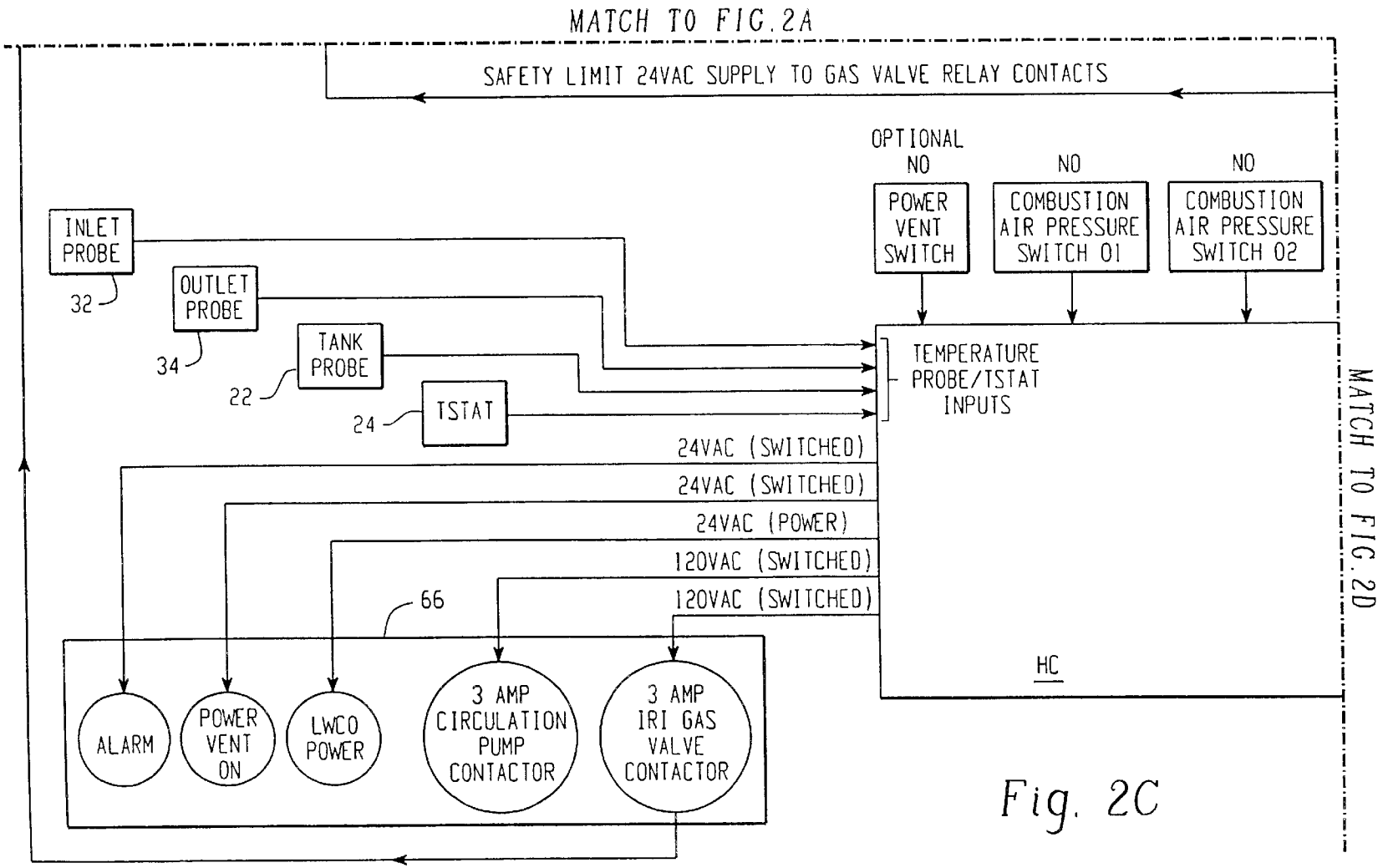
Figure 2D:
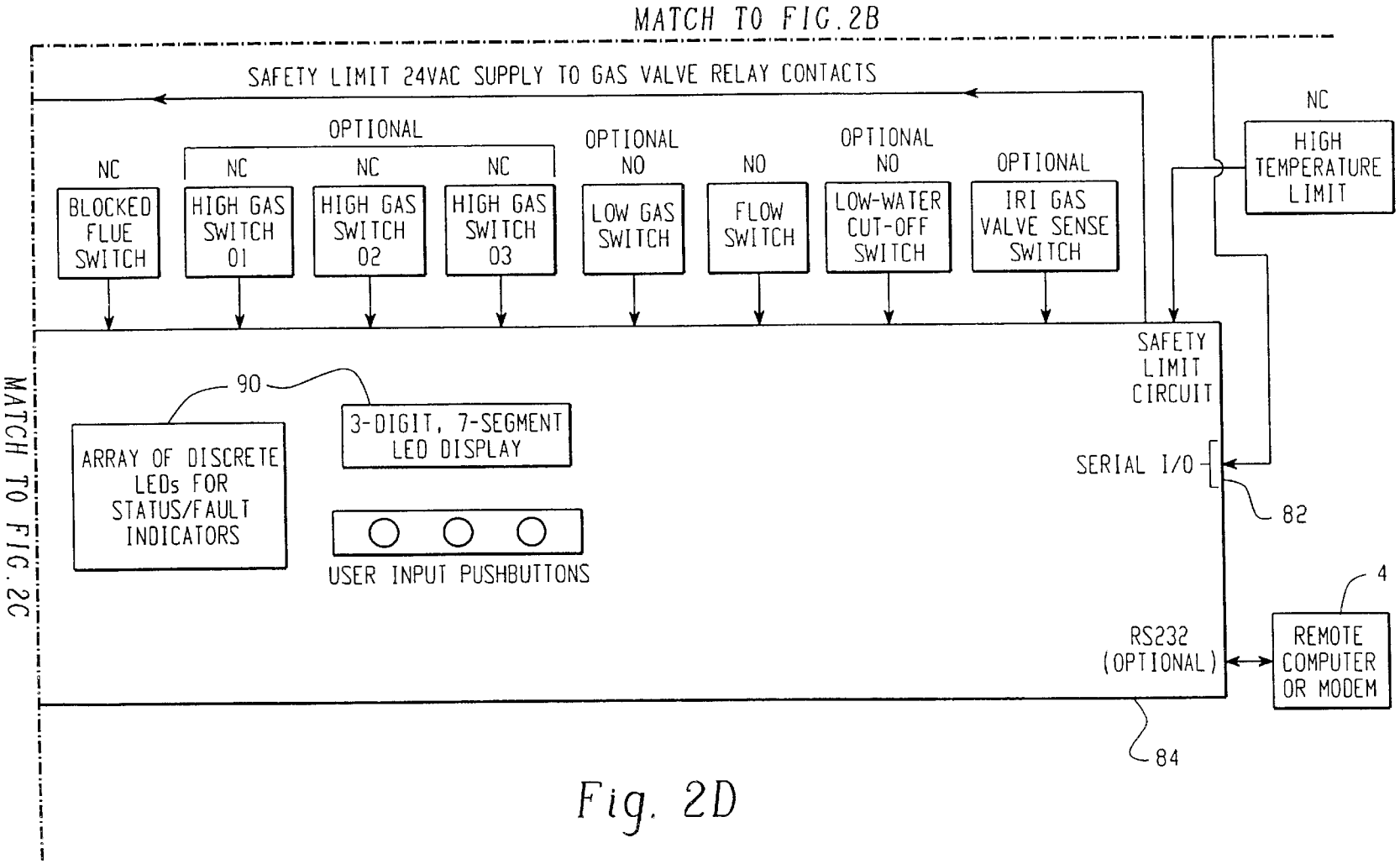

Referring now to the drawings wherein the showings are for the purposes of illustrating a preferred embodiment of the invention only and not for purposes of limiting same, FIG. 1 shows a block diagram of a water heating system 2. Water heating system 2 is generally comprised of a boiler 10, a tank 20, and a controller 30 which includes a host computer HC and a plurality of ignition controls IC1, IC2, and IC3. Boiler 10 includes a heat exchanger and a plurality of burner chambers BC1, BC2 and BC3. Each burner chamber houses a burner B1, B2, B3 which is respectively controlled by ignition controls IC1, IC2 and IC3. Water heated by boiler 10 is stored in tank 20, in accordance with one embodiment of the present invention. In turn, tank 20 provides a hot water supply. A boiler inlet temperature probe 32 (located near the inlet 12 of the boiler heat exchanger), a boiler outlet temperature probe 34 (located near the outlet 14 of the boiler heat exchanger) and a remote or tank temperature probe 22 provide temperature data to host computer HC for controlling ignition controls IC1, IC2 and IC3. Ignition controls IC1, IC2 and IC3 are preferably daisy-chained to each other, and share a communications bus, which acts as a communications medium. It should be appreciated that in some applications tank 20 may not be used (e.g., a space heating application). In such cases, tank temperature probe 22 is located at a suitable remote location. Controller 30, and operation thereof, will be described in further detail below.

It should be appreciated that while the present invention will be described with reference to a three-stage boiler, the present invention is suitable for use in connection with a boiler having a multiple number of stages. In this regard, it is noted that the number of boiler stages will typically depend upon a heating appliances' BTU rating. For boilers having fewer than three stages, fewer ignition controls are needed. In the case of boilers having more than three stages, additional ignition controls are utilized.

Referring now to FIG. 2, there is shown a detailed block diagram of controller 30, according to a preferred embodiment of the present invention. It should be appreciated that while the illustrated embodiment shows a water heating system having three burners, the present invention is applicable to water heating systems having any number of burners.

Controller 30 is generally comprised of host computer HC and ignition controls IC1, IC2 and IC3, which are in communication with host computer HC. Host computer HC is responsible for such items as sequencing the stages of the boiler, limit switch sensing, high limit safety circuit, inlet, outlet and tank temperature sensing, and remote thermostat. Host computer HC outputs control such items as an alarm, a power vent, a circulation pump, IRI gas valves and power for a low water cut-off device. It should be understood that ignition controls IC1, IC2 and IC3 are preferred heating control units. In this regard, where heating is provided by an electric heating element, heating control units suitable for an electric heating element are utilized.

Figure 3:
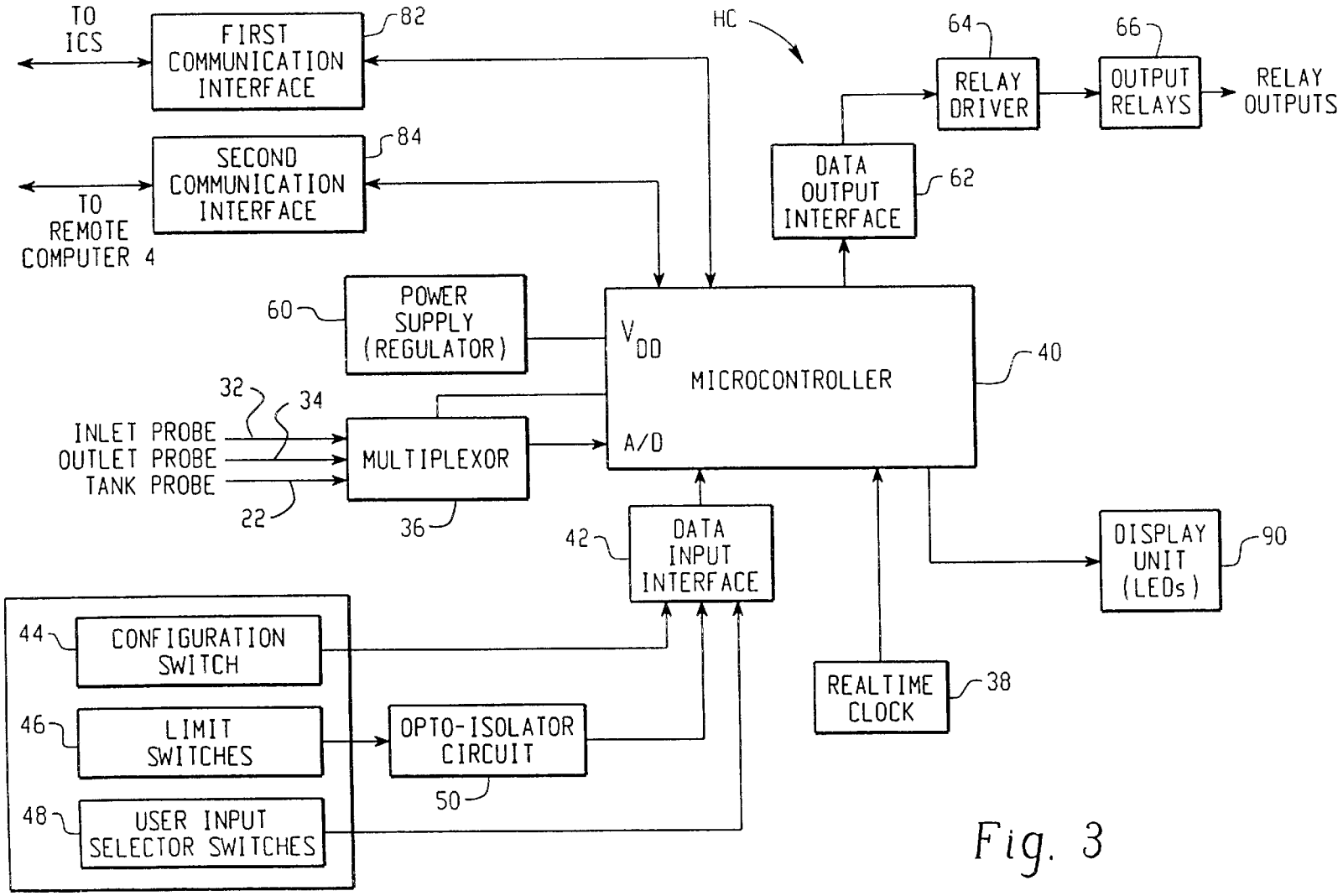
FIG. 3 is a detailed block diagram of a host computer system, according to a preferred embodiment of the present invention.

Host computer HC is shown in greater detail in FIG. 3. In this regard, host computer HC is generally comprised of a microcontroller 40, analog multiplexer (MUX) 36, an optional realtime clock 38, a data input interface 42, a power supply 60, and a data output interface 62, a first communication interface 82, a second communication interface 84, and a display unit 90. Host computer HC further comprises a configuration switch 44, limit switches 46, opto-isolator circuit 50, and user input selector switches 48, which communicate with microcontroller 40 via data input interface 42. In addition, host computer HC includes a relay driver 64 and output relays 66. Relay driver 64 is in communication with data output interface 62.

In accordance with a preferred embodiment, microcontroller 40 takes the form of a processor, such as an ST62T30 or ST6225B processor from SGS Thompson. It should be understood that other types of microprocessors or discrete processing circuits can be substituted for microcontroller 40, including processors with significantly greater processing power. Since a preferred embodiment of the present invention divides host computer tasks and ignition control tasks between a plurality of processors, each processor used can be relatively simple and inexpensive.

Microcontroller 40 controls multiplexer 36 to selectively output an analog signal from one of: inlet probe 32, outlet probe 34 and tank probe 22. The output analog signal is converted to a digital value using an A/D converter internal to microcontroller 40. Inlet probe 32 provides a signal indicative of the water temperature at the inlet of boiler 10, outlet probe 34 provides a signal indicative of the water temperature at the outlet of boiler 10, while remote or tank probe 22 provides a signal indicative of the temperature of the water stored in tank 20. In accordance with a preferred embodiment of the present invention, the probes 32, 34 and 22 include a thermistor (e.g., 10 KΩ@ 25° C.) located in an immersion probe housing.

A power supply circuit 60 provides an appropriate supply voltage to microcontroller 40.

First communication interface 82 provides I/O for communication between microcontroller 40 and the ignition controls IC1, IC2 and IC3. According to a preferred embodiment of the present invention, first communication interface 82 preferably takes the form of a serial I/O port, such as an RS-485 compatible interface (which operates in a half-duplex manner), an RS-232 compatible interface, or an RS-422 compatible interface. Microcontroller 40 "talks" to each ignition control by addressing each one individually. In this regard, each ignition control has a unique address. It should be appreciated that in accordance with a preferred embodiment, host computer HC will "lockout" controller 30 in the event that communication is lost with any ignition control IC1, IC2 and IC3. It should be understood that a "lockout" of controller 30 results in removal of power from the gas valve relays associated with the IRI gas valve (IGV1 and IGV2), as well as the gas valve relays associated with the gas valves of each burner stage (i.e., GV1, GV2, and GV3). A "lockout" requires a reset action by an operator, such as activation of an ENTER/RESET button.

Second communication interface 84 provides I/O communication between microcontroller 40 and an optional remote computer 4, a modem, or other device. Remote computer 4 can be used to monitor operations or reprogram microcontroller 40. According to a preferred embodiment of the present invention, second communication interface 84 takes the form of a serial I/O port, such as an RS-232 compatible interface, an RS-485 compatible interface, or an RS-422 compatible interface. It should be appreciated that remote computer 4 may be a computer that communicates with microcontroller 40 via a computer network, such as the Internet.

It should be understood that in a preferred embodiment of the present invention, first and second communication interfaces 82, 84 share the UART (Universal Asynchronous Receiver Transmitter) of microcontroller 40. However, first communication interface 82 is given higher priority in using the UART so that critical communications between host computer HC and the ignition controls are not interrupted.

As indicated above, a plurality of switches are input to microcontroller 40, including configuration switch 44, limit switches 46, and user input selector switches 48. Configuration switch 44 and user input selector switches are directly input to data input interface 42, while limit switches are input to data input interface 42 via opto-isolator circuit 50.

Configuration switch 44 preferably takes the form of a dip switch having a plurality of inputs. The dip switches of configuration switch 44 are set to select system parameters, such as the number of burner stages, the number of trials for ignition, whether signals generated by inlet probe 32 or tank probe 22 are used to give the call for heat, whether an external thermostat is connected, a selected maximum setpoint temperature for the boiler outlet before shutdown of controller 30 is initiated, a selected maximum setpoint temperature, and whether display unit 90 displays temperature values in degrees Fahrenheit or Celsius. It should be appreciated that in an alternative embodiment, jumpers could be used to replace the dip switches.

Limit switches 46 include a high limit switch, a low water cutoff switch (LWCO), a circulation pump flow switch, air pressure switches associated with each burner, a power vent switch, a blocked flue switch, a low gas switch, a high gas switch associated with each burner, and an IRI (Industrial Risk Insurers) gas valve switch. Limit switches 46 form a limit string, as well known to those skilled in the art, and are also connected to fault isolation circuitry (described below). In this regard, a fault occurring on any single limit switch is identified and reported by host computer HC for field diagnostic purposes. Accordingly, the limit switches are connected to fault isolation circuitry in parallel rather than series, as will be described in detail below.

The intent of a limit string is to provide a means of interrupting power to the main gas valve (or alternatively other heating element, such as electric heating coil and the like) in the event of an unsafe operating condition. Accordingly, the limit string requires that a series of conditions be true (evidenced by closed limit switches) before a voltage (e.g., 24 VAC) is applied to open IRI gas valves IGV1 and IGV2. Accordingly, the limit string provides a safety link for applying 24 VAC or 120 VAC to: (a) the IRI gas valve contactor which opens IRI gas valves IGV1 and IGV2, and (b) the gas valve relays which open gas valves GV1, GV2 and GV3 associated with each stage burner. It should be understood that IRI gas valves IGV1 and IGV2 act as redundant main gas valves, and thus control the flow of gas to gas valves GV1, GV2 and GV3, associated with each stage burner.

A typical limit string includes such items as (including but not limited to): a fuse; an ECO (Energy Cut-Out) relay switch; a circulation pump flow switch; a blocked flue switch; an IRI gas valve relay switch; burner gas valve relay switches; a blower pressure switch a low gas pressure switch, a high gas pressure switch and a blocked blower inlet switch, as well as other switches responsive to various operating conditions.

Limit switches 46 are connected to data input interface via opto-isolator circuit 50. Opto-isolator circuit 50 includes a contact conditioning circuit, and opto-isolators. The opto-isolators level shift the limit switch inputs (e.g., from 24 VAC to 5 VDC), provide noise isolation, and extend the sample time for detecting the status of the limit switches.

The high limit switch includes a high limit thermostat that resides in an immersion probe located at the outlet of boiler 10. The high limit thermostat is calibrated to open at a predetermined "high-limit" temperature (e.g., 118° C.). It is noted that bimetallic switches typically have a temperature resolution of approximately +/−3° C. According to a preferred embodiment the high limit thermostat takes the form of a bimetallic switch. The bi-metallic switch opens in response to sensing a temperature which exceeds its rated temperature (i.e., high-limit temperature). When the bimetallic switch opens, a 24 VDC supply is removed from a coil of a relay switch, causing the relay switch to open. Consequently, controller 30 enters a lockout condition.

The low water cutoff switch (LWCO) indicates whether the water level in the manifold of the boiler heat exchanger is below a predetermined level. The state of this switch is indicative of whether there is an appropriate volume of water in the manifold of the heat exchanger. Typically, the low water cutoff switch is located in close proximity to boiler outlet temperature probe 34.

The circulation pump flow switch is used to verify that there is water flow inside the heat exchanger of boiler 10. Accordingly, the circulation pump flow switch is located at boiler outlet 14 to detect the flow of water when the circulation pump has been activated.

The power vent switch proves that a power vent associated with the flue has been activated. It should be understood that the power vent assists in expelling combustion gases through the flue.

Each air pressure switch is used to verify that the combustion blower is generating pressure in the respective burner chamber, when the combustion blower is activated. Accordingly, the air pressure switches respond to the pressure in respective burner chambers.

The blocked flue switch is a pressure switch which responds to the pressure in the flue. Accordingly, the blocked flue switch will open in response to a blocked flue.

The low gas pressure switch responds to the pressure of the gas on the line side of gas valves GV1, GV2, and GV3 (or alternatively, the line side of IRI gas valves IGV1 and IGV2), while each of the high gas pressure switches respond to the pressure of the gas on the burner side of the respective burner gas valve. The low and high gas pressure switches are respectively adapted to respond to low and high gas pressure thresholds. Accordingly, the low gas pressure switch opens in response to a low gas pressure in the gas line, while the high gas pressure switches open in response to a high gas pressure in the gas line.

The IRI gas valve switch indicates whether the IRI gas valves are functioning (i.e., proof of closure switch).

It should be further noted that an external thermostat 24 input is optionally input to microcontroller 40 via opto-isolator circuit 50 and data input interface 42. Typically, external thermostat 24 takes the form of a bi-mettalic device wherein a temperature drop below a predetermined threshold closes the contacts. The external thermostat is typically used in a space heating application to provide an indication of ambient temperature.

User input selector switches 48 are used by the operator to select parameters to adjust or display, adjusting a user programmable parameter, saving newly entered parameters, reset the control when a controller "lockout" occurs, and the like. In accordance with a preferred embodiment, switches 48 take the form of a plurality of momentary contact pushbutton switches, including an ADJUST, a SELECT, and an ENTER/RESET pushbutton switches.

Figure 5:
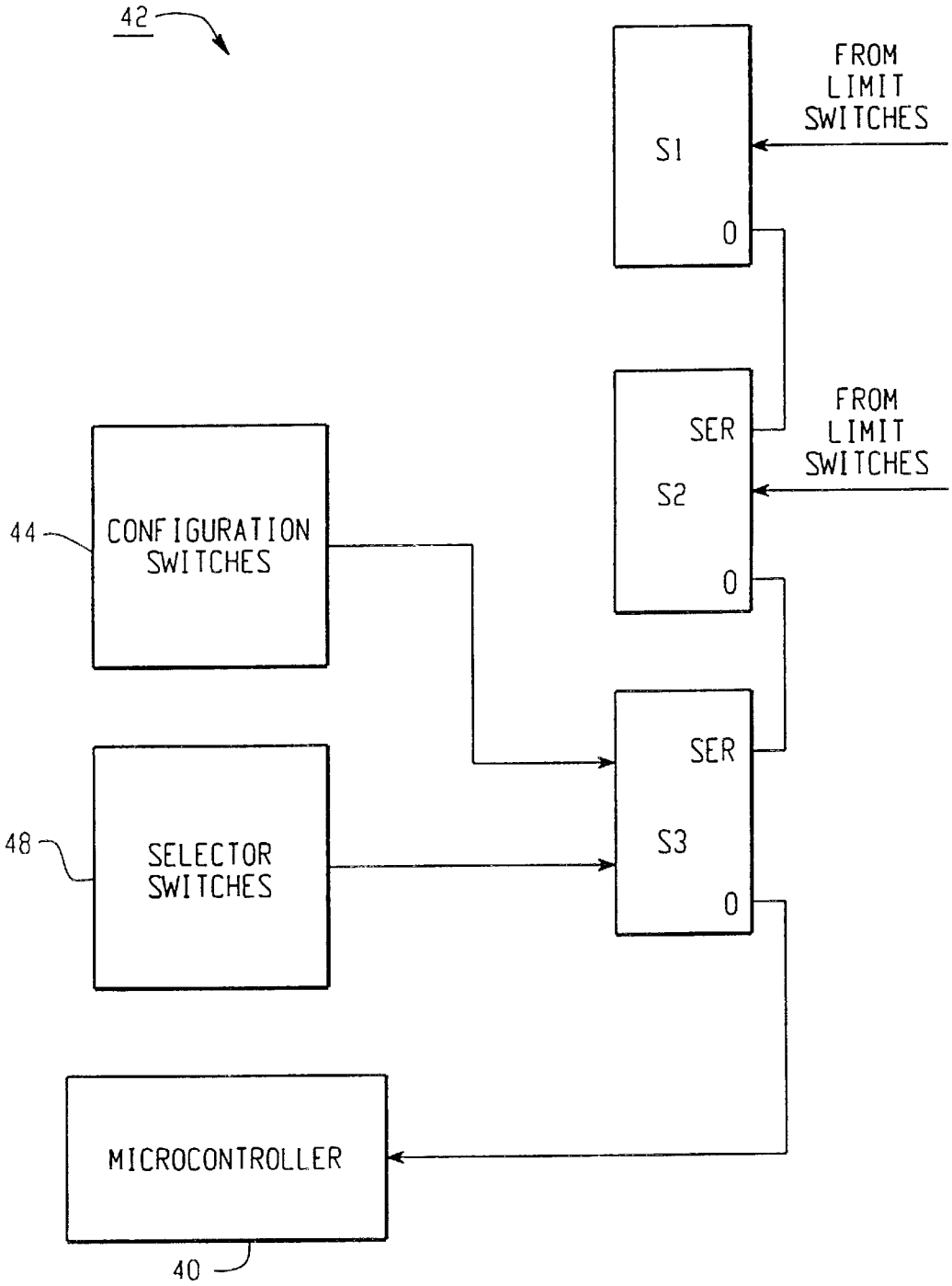
FIG. 5 is a schematic diagram of a data input interface, according to a preferred embodiment of the present invention.

Data input interface 42 provides an interface for inputting data to microcontroller 40 (FIG. 5). In accordance with a preferred embodiment, data input interface 42 includes a plurality of 8-bit parallel-to-serial shift registers S1, S2 and S3. The parallel inputs to the shift register include output signals from configuration switch 44, output signals from opto-isolation circuit 50, which indicates the state of each of the limit switches 46, and output signals from user input selector switches 48. It should be understood that the number of shift registers may vary depending upon the number of inputs and the size of the shift registers.

As mentioned above, limit switches 46 are connected to fault isolation circuitry, so that a fault occurring on any single limit switch can be identified and reported by host computer HC for field diagnostic purposes. In this regard, data input interface 42 and microcontroller 40 provide fault isolation circuitry. To this end, shift registers S, S2, and S3 clock the state of limit switches 46 into microcontroller 40. It should be appreciated that in an alternative embodiment the limit switches can be input in parallel to the microcontroller, where sufficient inputs are available. The shift registers of the preferred embodiment are used to minimize the need for numerous data inputs in microcontroller 40.

Microcontroller 40 is programmed to continuously scan the state of limit switches 46 to determine whether they are in the proper state during all phases of an ignition control cycle. In accordance with a preferred embodiment, a 3-byte word is input to microcontroller 40. The status of each of the bits is evaluated (e.g., by comparison to values stored in a look-up table indicative of various operating states) to determine whether the status of the associated component is appropriate for the current operating state (e.g., call-for-heat/pre-circulate, pre-purge, warm-up, trial for ignition, heating, post purge, and post circulate). Set forth below is a list of exemplary fault conditions and corresponding error codes generated by microcontroller 40.

| FAULT CONDITION | ERROR CODE |
|---|---|
| Communication Fault - Stage 1 | 001 |
| Communication Fault - Stage 2 | 002 |
| Communication Fault - Stage 3 | 003 |
| ECO/High Limit | 010 |
| No Gas Valve Power Sensed - Stage 1 | 011 |
| No Gas Valve Power Sensed - Stage 2 | 012 |
| No Gas Valve Power Sensed - Stage 3 | 013 |
| LWCO | 020 |
| Circulate Fault (Flow Switch) | 030 |
| Insufficient Air (Air Pressure Switch) - Stage 1 | 041 |
| Insufficient Air (Air Pressure Switch) - Stage 2 | 042 |
| Insufficient Air (Air Pressure Switch) - Stage 3 | 043 |
| Blocked Flue | 060 |
| Power Vent | 070 |
| Igniter Failure - Stage 1 | 081 |
| Igniter Failure - Stage 2 | 082 |
| Igniter Failure - Stage 3 | 083 |
| Low Gas Failure | 090 |
| High-Gas Failure - Stage 1 | 101 |
| High-Gas Failure - Stage 2 | 102 |
| High-Gas Failure - Stage 3 | 103 |
| Gas Valve Relay Failure - Stage 1 | 111 |
| Gas Valve Relay Failure - Stage 2 | 112 |
| Gas Valve Relay Failure - Stage 3 | 113 |
| Flame Failure - Stage 1 | 121 |
| Flame Failure - Stage 2 | 122 |
| Flame Failure - Stage 3 | 123 |
| Probe Faults - Outlet Probe | 131 |
| Probe Faults - Inlet Probe | 132 |
| Probe Faults - Remote/Tank Probe | 133 |

-continued

| FAULT CONDITION | ERROR CODE |
|---|---|
| IRI Gas Valve Failure | 140 |
| Microcontroller Fault | 210 |

It should be appreciated that the data input to microcontroller 40 concerning the state of the limit switches, allows for identification of the specific component which is the source of the malfunction. By reporting the identified malfunctioning component to the operator using display unit 90, service technicians can quickly make repairs.

Realtime clock 38 provides a time signal to microcontroller 40 so that microcontroller can be conveniently programmed to operate water heating system 2 according to a timer schedule. For instance, controller 30 could be set to operate in different modes during evening or weekend hours, or during holiday and vacation periods.

Display unit 90 may take numerous suitable forms, including LED, LCD and CRT displays. In accordance with a preferred embodiment, display unit 90 includes a plurality of multi-colored LEDs, including a four digit, seven segment LED display that indicates inlet temperature, outlet temperature or tank temperatures, setpoint temperatures and setpoint differentials, error codes, cycle counts, post-circulation pump time, and last error. Display unit 90 further includes a plurality of discrete LEDs which illuminate to communicate information identifying stages, providing diagnostics, and acting as system indicators. More specifically, the "diagnostic" LEDs may indicate such items as ECO failure, flame failure, igniter failure, insufficient air, blocked flue, probe failure, circulate failure, gas valve failure, high gas failure, low gas failure, low water cut-off, and power vent failure. The "indicator" LEDs are provided to identify the display of such items as inlet water temperature, outlet water temperature, stage setpoint temperature, stage setpoint differential, and standby. It should be appreciated that the use of LEDs as described above is merely for illustrating a preferred embodiment, and is not intended to limit the type of suitable display units.

Microcontroller 40 controls output relays 66 by outputting data via data output interface 62 and relay driver 64. In accordance with a preferred embodiment, data output interface takes the form of a serial-to-parallel shift register. As data bits are latched in the shift register outputs, relays controlling such items as an alarm, a power vent, a circulation pump, and IRI gas valves IGV1, IGV2, are turned on and off at the appropriate times.

Figure 4:
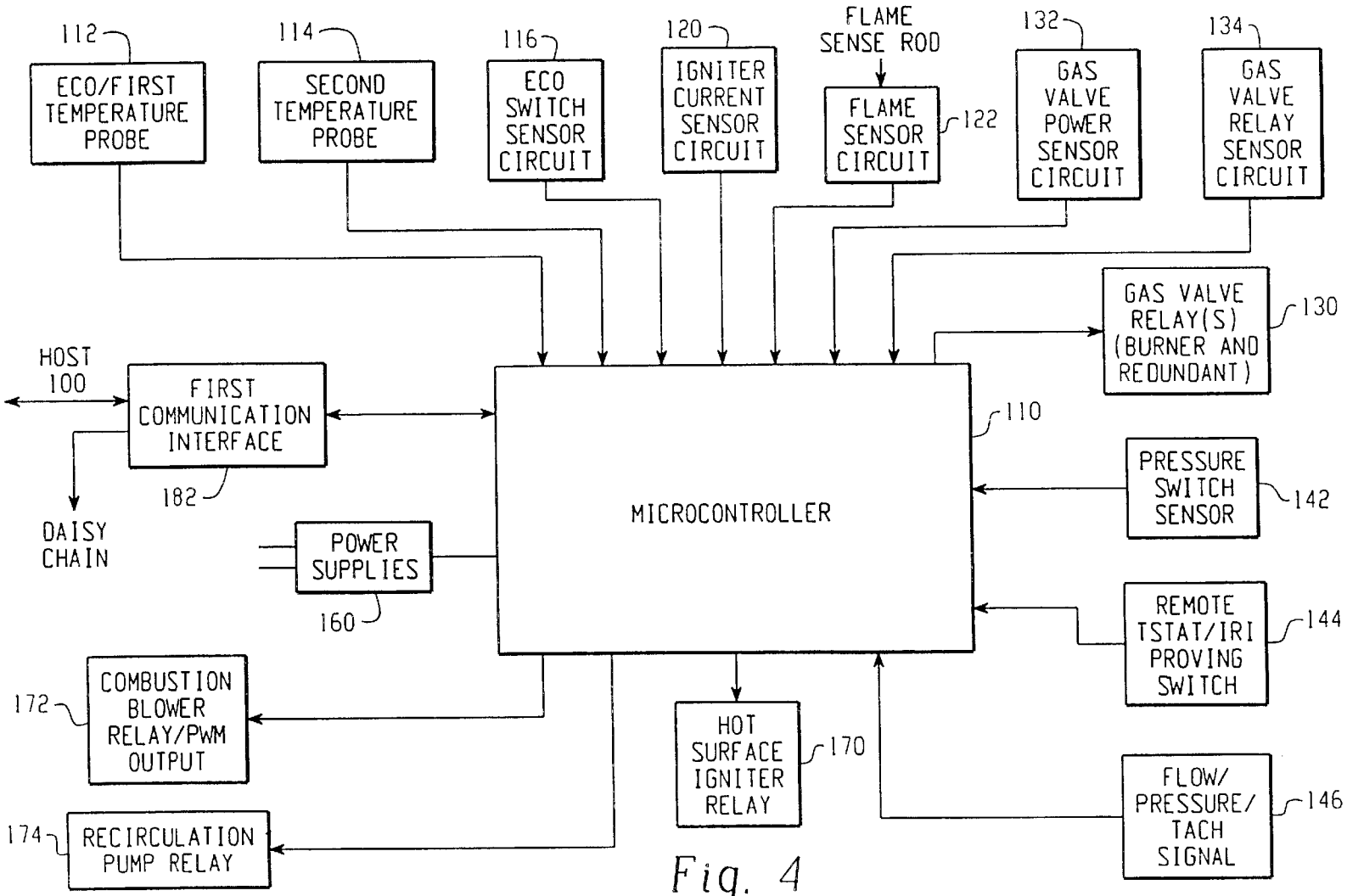
FIG. 4 is a detailed block diagram of an ignition control, according to a preferred embodiment of the present invention.

Turning now to FIG. 4, ignition control IC1 will be described in detail. It will be appreciated that the other ignition controls IC2, IC3 (and any necessary additional ignition controls) are similarly configured. In general, ignition controls are responsible for controlling associated combustion blowers, hot surface igniters (HSI), and gas valves. Moreover, each ignition control is capable of monitoring gas valve power, gas valve relay, flame sense and igniter current.

Ignition control IC1 is generally comprised of a microcontroller 110, a communication interface 182, gas valve relays (burner and redundant) 130, a gas valve power sensor circuit 132, a gas valve relay sensor circuit 134, an igniter current sensor circuit 120, a flame sensor circuit 122, and power supplies 160.

In an accordance with an alternative embodiment of the present invention, the ignition controls may be operated separately and independently from host computer HC. In this embodiment, ignition control IC1 also includes an ECO/first temperature probe 112, a second temperature probe 114, a ECO switch sensor circuit 116, a pressure switch sensor 142, a remote thermostat/IRI proving switch 144 and a flow/pressure/tach signal 146. Tach signal 146 provides feedback from a variable speed motor used in connection with the combustion blower.

In accordance with a preferred embodiment, microcontroller 110 takes the form of a processor, such as an ST62T30 or ST6225B processor from SGS Thompson. It should be understood that other types of microprocessors or discrete processing circuits can be substituted for microcontroller 110, including processors with significantly greater processing power. As mentioned above, since a preferred embodiment of the present invention divides host computer tasks and ignition control tasks between a plurality of processors, each processor used can be relatively simple and inexpensive.

Communication interface 182 provides I/O for communication between microcontroller 110 and host computer HC. According to a preferred embodiment of the present invention, communication interface 182 takes the form of a serial I/O port, such as an RS-485 compatible interface (which operates in a half-duplex manner), an RS-232 compatible interface, or an RS-422 compatible interface. In accordance with a preferred embodiment, each ignition control has a unique address. Accordingly, microcontroller 110 will take control of the communications bus and transmit when instructed by host computer HC. It should be understood that in a preferred embodiment, the ignition controls IC1, IC2 and IC3 are daisy-chained.

Gas valve power sensor circuit 132 senses whether power (e.g., 24 VAC) is being provided to the relay contacts of the respective gas valve GV1. In accordance with a preferred embodiment of the present invention, power is sensed through a resistor. Accordingly, an appropriate 'digital' voltage is input to microcontroller 110. If no power is sensed, then microcontroller 110 will cause a "lockout" of controller 30. As indicated above, "lockout" of controller 30 results in removal of power from the gas valve relays associated with the IRI gas valves (IGV1 and IGV2), as well as the gas valve relays associated with the gas valves of each burner stage (i.e., gas valves GV1, GV2, and GV3).

Gas Valve GV1 is preferably powered by a pair of relays. The first relay switches the gas valve OPEN/CLOSED, while the second relay merely provides redundancy. Gas valve relay sensor circuit 134 senses the state of the first relay, and provides status information to microcontroller 110. In accordance with a preferred embodiment of the present invention, activation of the first relay is sensed through a resistor. Therefore, an appropriate 'digital' voltage is input to microcontroller 110. In this manner, microcontroller 110 can verify and monitor the state of the first relay. Accordingly, microcontroller 110 may be programmed to "lockout" controller 30 if the relay contact in not in the proper position in a particular control state.

In accordance with a preferred embodiment, a 120 VAC or 24 VAC igniter is energized by hot surface igniter relay 170. It should be appreciated that the present invention is also suitably used in connection with other types of ignition systems, including standing pilot and spark ignition systems.

Igniter current sensor circuit 120 proves the presence of a "hot" surface igniter by validating the igniter current flowing therethrough. If inadequate igniter current is sensed prior to opening the respective gas valve GV1, microcontroller 110 will not allow the associated gas valve relays 130 (including burner and redundant relays) to energize. Consequently, gas valve GV1 will not open. This prevents the buildup of gas which could cause an explosion when ignited by the igniter. In accordance with a preferred embodiment, microcontroller 110 is programmed to attempt a predetermined number of trials (e.g., 1 or 3 trials) for sufficient igniter current. If sufficient current is not sensed during one of the trials, controller 30 will "lockout." Controller 30 will also "lockout" if igniter current is sensed during a control state when there should be no igniter current.

In accordance with a preferred embodiment, igniter current sensor circuit 120 preferably uses a current sense transformer. In this regard, igniter current passes through the transformer primary winding. Current induced into the transformer secondary winding generates a voltage across a burden resister, which is amplified and scaled (e.g., 1V/Amp) by an op-amp circuit. This scaled output voltage is input to microcontroller 110, which performs an analog-to-digital conversion. If the scaled output voltage is less than a predetermined value (e.g., 2.7 volts), microcontroller 110 determines that there is inadequate igniter current. It should be appreciated that the digitized scaled output voltage may also be displayed to the operator on display unit 90 for use as a diagnostic tool and igniter performance indicator.

Flame sensor circuit 122 receives input from a flame sense rod, which is a probe located in the gas flame of the respective burner. The flame sense rod preferably detects the presence of a flame using a well known technique referred to as "flame rectification." In accordance with a preferred embodiment of flame sensor 122, a capacitor is charged by an op-amp circuit during the first half of a charge/discharge cycle, and is discharged by flame rectification during the second half of the charge/discharge cycle. The average current resulting from this charge/discharge cycle is what is measured as the flame current by flame sensor circuit 122. Microcontroller 110 is programmed to constantly monitor the flame current. If microcontroller 110 determines that there is insufficient flame current during a "heat mode," the ignition control IC1 will begin another attempt to light gas until a predetermined number of ignition trials (e.g., 1 or 3 trials) are completed. Moreover, ignition control IC1 will "lockout" if adequate flame current has not been sensed, or if flame current is sensed during a control state when flame current should not exist.

In accordance with a preferred embodiment, power supplies 160 includes three regulated power supplies, which respectively provide +24 VDC, +15 VDC and +5 VDC.

Microcontroller 1 10 controls the state of combustion blower CB1 through a combustion blower relay 172 and controls the state of the recirculation pump through a recirculation pump relay 174.

In accordance with a first alternative embodiment, combustion blower CB1 operates at two speeds, namely low speed and high speed. Microcontroller 110 (or microcontroller 40) controls the operating speed. At ignition (i.e., while the respective hot surface igniter is activated), combustion blower CB1 is operated at the low speed. At other times, combustion blower CB1 is operated at high speed. Therefore, combustion blower CB1 shifts to low speed at ignition, and once ignition is completed (e.g., when an appropriate flame is sensed), combustion blower CB1 resumes operation at high speed. The foregoing operation facilitates ignition under lean mixture conditions.

In accordance with another alternative embodiment of the present invention, microcontroller 110 controls operation of combustion blower CB1 using a variable output signal (e.g., a pulse width modulation (PWM) output signal). In this alternative embodiment, the variable output signal provides adaptive control of combustion blower CB1, which may take the form of a variable-speed combustion blower. Likewise, microcontroller 110 (or microcontroller 40) may provide a variable output signal for adaptive control of other items such as a variable-speed circulation pump, and/or variable gas valve. These variable output signals provide a range of values, rather than just an ON and OFF value. Moreover, the microcontrollers may receive inputs from pressure and/or flow transducers, which provide feedback information from the combustion blower, pump and/or gas valve. This feedback information is used by the microcontrollers to modulate the output control signals.

As indicated above, in an alternative embodiment of the present invention, the ignition controls may be used separately and independently from host computer HC. Accordingly, an ECO probe/first probe 112 may be used to provide temperature information indicative of water temperature at the inlet to a heating chamber, while second probe 114 may be used to provide temperature information indicative of water temperature at the outlet of a heating chamber. Probes 112 and 114 preferably take the form of a thermistor.

Furthermore, in accordance with this alternative embodiment, the ECO probe is located at the first probe to sense a high-limit temperature. ECO switch sensor circuit 116 evaluates the data received from the ECO probe, and operates independently of microcontroller 110. In this regard, ECO switch sensor circuit 116 includes circuitry for determining whether the temperature has exceeded a "high limit" temperature (e.g., 250 degrees F.), and whether there is an open ECO probe (fault condition). When this condition is sensed, ECO switch sensor circuit 116 causes all gas valve relay switches to open, which in turn closes gas valves IGV1, IGV2, GV1, GV2, and GV3. ECO switch sensor circuit 116 also provides a signal to microcontroller 110 indicative of the state of the ECO probe.

Pressure switch sensor 142 provides a signal to microcontroller 110 indicative of the state of a blower pressure switch. The blower pressure switch is used to verify that combustion blower CB1 is generating pressure in the respective burner chamber, when combustion blower CB1 is activated. Accordingly, the pressure switch responds to the pressure in the burner chamber. The blower pressure switch is closed when the pressure reaches a predetermined level.

Remote thermostat 144 is optionally connected with microcontroller 110. When remote thermostat 144 is in use, microcontroller 110 looks for an external thermostat signal which "overrides" ("AND" function) the local setpoint temperature provided by host computer HC. Typically, external thermostat 144 takes the form of a bi-mettalic device wherein a temperature drop below a predetermined threshold closes the contacts. The external thermostat is typically used in a space heating application to provide an indication of ambient temperature.

It should be understood that each ignition control IC1, IC2, IC3 may have different components, since such elements as combustion blower and hot surface igniter (HSI) may not be needed for each burner stage. For instance, the flame generated in the first stage burner can be utilized to ignite the flame in subsequent stage burners ("flame carryover"). Therefore, an HSI is needed only for the first stage burner.

The invention has been described with reference to a preferred embodiment. Obviously, modifications and alterations will occur to others upon a reading and understanding of this specification. For instance, the present invention has been described with particular reference to a gas appliance. It is contemplated that the present invention may be suitably modified to control an electric appliance. It is intended that all such modifications and alterations be included insofar as they come within the scope of the appended claims or the equivalents thereof.

Having thus described the invention, it is now claimed:

1. An appliance controller for controlling an associated gas heating appliance having a plurality of gas-fired burner means, the appliance controller comprising:

a plurality of ignition control means, each of said ignition control means controlling ignition of a respective associated gas-fired burner means of said gas heating appliance;

a host computer for controlling operation of the plurality of ignition control means; and a communications medium for facilitating communication between the host computer and the plurality of ignition control means.

2. An appliance controller according to claim 1, wherein each of said ignition control means respectively controls an ignition means for firing the respective associated gas-fired burner means.

3. An appliance controller according to claim 2, wherein said ignition means is a hot surface igniter, each of said ignition control means including ignition current proving circuit means for establishing whether there is sufficient current for the hot surface igniter to ignite gas of the associated gas-fired burner means.

4. An appliance controller according to claim 1, wherein each of said ignition control means receives flame sense data indicative of the state of a burner flame of the respective associated gas-fired burner means.

5. An appliance controller according to claim 1, wherein said host computer receives temperature data from a temperature sensing means, said temperature data indicative of the temperature of water prior to heating by at least one of said plurality of gas-fired burner means, and the temperature of water after heating by at least one of said plurality of gas-fired burner means.

6. An appliance controller according to claim 5, wherein said temperature data is further indicative of the temperature of water stored in an associated storage tank.

7. An appliance controller according to claim 1, wherein said associated gas heating appliance is a boiler.

8. An appliance controller according to claim 1, wherein said host computer further comprises:

input means for programming said controller; and display means for displaying controller data.

9. An appliance controller according to claim 1, wherein said host computer includes fault isolation means for isolating the source of an appliance malfunction.

10. An appliance controller according to claim 9, wherein said fault isolation means includes:

receiving means for receiving status data indicative of the status of appliance components; and evaluation means for evaluating status data to identify the source of the appliance malfunction.

11. An appliance controller according to claim 10, wherein said receiving means includes at least one parallel-to-serial shift register.

12. An appliance controller according to claim 10, wherein said evaluation means includes a processor.

13. An appliance controller according to claim 10, wherein said evaluation means compares the status data to data stored in a lookup table indicative of various operating states.

14. An appliance controller according to claim 10, wherein said evaluation means controls a display means to indicate the source of the malfunction.

15. An appliance controller according to claim 1, wherein each of said ignition control means are daisy-chained to each other to communicate with the host computer via the communication medium.

16. An appliance controller for controlling an associated gas heating appliance having a plurality of heating means, the appliance controller comprising:

a plurality of heat control means, each of said heat control means controlling activation and deactivation of a respective associated heating means of said gas heating appliance;

a host computer for controlling operation of the plurality of heat control means; and a communications medium for facilitating communication between the host computer and the plurality of heat control means.

17. An appliance controller according to claim 16, wherein said host computer receives temperature data from a temperature sensing means, said temperature data indicative of the temperature of water prior to heating by at least one of the plurality of heating means, and the temperature of water after heating by at least one of the plurality of heating means.

18. An appliance controller according to claim 17, wherein said temperature data is further indicative of the temperature of water stored in an associated storage tank.

19. An appliance controller according to claim 16, wherein said associated appliance is a boiler.

20. An appliance controller according to claim 16, wherein said host computer further comprises:

input means for programming said controller; and display means for displaying controller data.

21. An appliance controller according to claim 16, wherein said host computer includes fault isolation means for isolating the source of an appliance malfunction.

22. An appliance controller according to claim 21, wherein said fault isolation means includes:

receiving means for receiving status data indicative of the status of appliance components; and evaluation means for evaluating status data to identify the source of the appliance malfunction.

23. An appliance controller according to claim 22, wherein said receiving means includes at least one parallel-to-serial shift register.

24. An appliance controller according to claim 22, wherein said evaluation means includes a processor.

25. An appliance controller according to claim 22, wherein said evaluation means compares the status data to data stored in a lookup table indicative of various operating states.

26. An appliance controller according to claim 22, wherein said evaluation means controls a display means to indicate the source of the malfunction.

27. An appliance controller according to claim 16, wherein said plurality of heat control means are daisy-chained to each other to communicate with the host computer via the communication medium.

28. An appliance controller according to claim 16, wherein said controller generates variable output signals to provide adaptive control of one or more appliance components selected from the group consisting of: a variable speed combustion blower, a variable speed circulation pump, and a variable gas valve.

29. An appliance controller according to claim 16, wherein said gas heating appliance includes:

a blower for blowing air into a combustion chamber housing said plurality of heating means, wherein said blower has at least two different operating speeds said operating speed determined by said host computer.

30. An appliance controller according to claim 29, wherein said blower has a low speed and a high speed, said host computer operating the blower at the low speed during an ignition mode, and operating at the high speed subsequent to ignition.

31. An appliance controller according to claim 29, wherein said blower has variable speeds, said host computer varying the speed of the blower in accordance with sensed conditions.

32. An appliance controller according to claim 16, wherein said appliance controller further comprises fault condition isolation means, including;

means for receiving status information indicative of the state of a plurality of components of the appliance;

means for inputting the status information in parallel into a shift register;

means for outputting the status information from the shift register in serial, wherein status information is transmitted to the host computer for evaluating the received status information to determine if a fault condition exists; and displaying a signal indicative of the fault condition.

33. An appliance controller according to claim 32, wherein said host computer includes a lookup table for evaluation of said status information.

* * * * *